US008572896B2

(12) United States Patent
Busch

(10) Patent No.: US 8,572,896 B2
(45) Date of Patent: Nov. 5, 2013

(54) LINEAR DRIVE FOR SLIDING DOORS OR THE LIKE

(75) Inventor: Sven Busch, Dortmund (DE)

(73) Assignee: Dorma GmbH + Co. KG, Ennepetal (DE)

( * ) Notice: Subject to any disclaimer, the term of this patent is extended or adjusted under 35 U.S.C. 154(b) by 505 days.

(21) Appl. No.: 12/192,703

(22) Filed: Aug. 15, 2008

(65) Prior Publication Data

US 2009/0045760 A1 Feb. 19, 2009

(30) Foreign Application Priority Data

Aug. 16, 2007 (DE) ..... 10 2007 038 840

(51) Int. Cl.
*E05F 11/54* (2006.01)

(52) U.S. Cl.
USPC ..... 49/360

(58) Field of Classification Search
USPC ..... 49/360, 358; 310/12, 13, 14
See application file for complete search history.

(56) References Cited

U.S. PATENT DOCUMENTS 1,881,014 A * 10/1932 Ayers ..... 49/360
1,916,491 A * 7/1933 Rose ..... 310/13
1,986,616 A * 1/1935 Baldwin ..... 310/13
1,986,639 A * 1/1935 Konn ..... 310/13
2,337,430 A * 12/1943 Trombetta ..... 310/13
3,331,428 A * 7/1967 Ford ..... 160/331
4,333,446 A * 6/1982 Smyth ..... 126/574
4,500,376 A * 2/1985 DeLigt ..... 156/159
4,641,065 A * 2/1987 Shibuki et al. ..... 318/135
5,134,324 A * 7/1992 Sakagami et al. ..... 310/12.04
5,172,518 A * 12/1992 Yoshino ..... 49/360
5,175,455 A * 12/1992 Penicaut ..... 310/12.25
5,179,304 A * 1/1993 Kenjo et al. ..... 310/12.27
5,302,873 A * 4/1994 Takei ..... 310/12.24
5,668,355 A * 9/1997 Jaminet et al. ..... 187/316
5,712,516 A * 1/1998 Kabout ..... 310/12.04
5,736,693 A * 4/1998 Piech et al. ..... 187/316
5,852,897 A * 12/1998 Sukale ..... 49/358
6,289,643 B1 * 9/2001 Bonar ..... 52/207
6,326,708 B1 * 12/2001 Tsuboi et al. ..... 310/12.06
6,449,905 B2 * 9/2002 Maki ..... 49/360

(Continued)

FOREIGN PATENT DOCUMENTS

JP 06101379 A * 4/1994

OTHER PUBLICATIONS

Brockhaus Enzyklopadie in vierundzwanzig Bäden Neunzehnte, völlig neu bearbeitete Auflage Dreizehnte Band Lah—Maf F.A. Broekhaus Mannheim, pp. 415-416.

*Primary Examiner* — Jerry Redman
(74) *Attorney, Agent, or Firm* — Cozen O'Connor

(57) ABSTRACT

A linear drive for sliding doors, particularly linear drives based on linear motors. A linear drive, for at least one part which is movable along a movement path, particularly a sliding door leaf, has at least one linear motor for the at least one part. A stator part of the linear motor is received in a receiving profile so as to be prevented from falling out. The receiving profile is constructed to be arranged at a fastening device, which is arranged in turn on the installation side of a wall portion or top portion. Accordingly, the stator part and receiving profile form a module or unit, which can be mounted in its entirety. Therefore, a person performing the mounting can use the receiving profile for mounting, which helps to reduce the risk of damaging the stator part.

16 Claims, 5 Drawing Sheets

(56) References Cited

U.S. PATENT DOCUMENTS

| | | | | |
|---|---|---|---|---|
| 6,467,584 | B2 * | 10/2002 | Yamamoto et al. | 187/316 |
| 6,490,832 | B1 * | 12/2002 | Fischbach et al. | 52/207 |
| 6,516,566 | B2 * | 2/2003 | Finke | 49/127 |
| 6,543,581 | B1 * | 4/2003 | Durand et al. | 187/316 |
| 6,581,332 | B1 * | 6/2003 | Kim | 49/358 |
| 6,675,938 | B2 * | 1/2004 | Yamamoto et al. | 187/316 |
| 6,832,449 | B2 * | 12/2004 | Rennetaud et al. | 49/120 |
| 7,578,096 | B2 * | 8/2009 | Haab et al. | 49/409 |
| 7,592,720 | B2 * | 9/2009 | Busch | 310/12.24 |
| 7,608,949 | B2 * | 10/2009 | Busch | 310/14 |
| 2005/0172563 | A1 * | 8/2005 | Komoda | 49/358 |
| 2007/0251150 | A1 * | 11/2007 | Harie | 49/358 |

* cited by examiner

LINEAR DRIVE FOR SLIDING DOORS OR THE LIKE

BACKGROUND OF THE INVENTION

1. Field of the Invention

The invention is directed to a linear drive for sliding doors or the like, particularly linear drives including linear motors.

2. Description of the Related Art

Linear motor drives for sliding door systems and the like are known. The disclosed drives comprise a linear motor arranged to extend along at least part of a movement path of a respective sliding door leaf. Mounting can be carried out in a space-saving manner. A supporting profile receives at least one stator of at least one linear motor. Associated rotors are arranged at a respective sliding door leaf and can be provided with rollers that are arranged so as to roll on guide rails.

SUMMARY OF THE INVENTION

An object of the present invention is to provide a linear drive with improved mounting.

A linear drive according to one embodiment of the invention for at least one part, particularly a sliding door leaf, which is movable along a movement path has at least one linear motor for the at least one part. A stator part of the linear motor is received in a receiving profile to be prevented from falling out. The receiving profile is constructed to be arranged at a fastening device that is arranged in turn on the installation side of a wall portion or top portion. Accordingly, the stator part and receiving profile form a module or unit that can be mounted in its entirety. Therefore, the receiving profile is used for mounting, which helps reduce the risk of damaging the stator part.

The receiving profile preferably has a slide-on portion at least on an outer side of a side wall. Accordingly, it is possible to arrange the receiving part on other parts, with or without screws. The slide-on portion preferably has a dovetail-like cross-sectional shape considered in longitudinal direction of the receiving profile. This construction of the slide-on portion presents a particularly elegant solution for said arrangement.

An accessory profile is advantageously arranged at a side of the receiving portion remote of the fastening device, which is designed to receive accessory devices of the linear drive such as, e.g., a locking module, an emergency exit module, an energy accumulator and/or a sensor module. This means that the accessory devices are not inserted in the receiving profile for the stator of the linear drive as is customary, but rather are accommodated so as to be spatially separated from the latter. This makes it possible to integrate accessory devices in the linear drive even subsequently without having to remove the linear drive.

The receiving profile preferably has a slide-on portion at least on an outer side facing the accessory profile. In this case, the accessory profile in turn has, on a side facing the receiving profile, a slide-on portion complementing the other slide-on portion. Accordingly, the receiving profile and accessory profile can be fitted to one another by means of the slide-on portions that are constructed so as to face one another.

Further, the fastening device preferably comprises a suspending profile in which the receiving profile is received so as to be prevented from falling out. This has the advantage that the receiving profile is not itself arranged, for example, at an installation-side wall or top. Rather, it is received in the suspending profile. Accordingly, this suspending profile can be optimized with respect to the receiving profile because there are no restrictions caused by a stator needing to be held.

Alternatively, the suspending profile is designed in such a way that the receiving profile is arranged in a stationary manner at the suspending profile, i.e., the suspending part does not receive the receiving profile.

Further, the fastening device preferably comprises a fastening part. This fastening part serves to fix the suspending profile and is provided to be arranged at a side of an installation-side wall or stationary part remote of the linear drive and to be fastened to the suspending profile. The suspending profile is arranged at a side of the installation-side wall or of the stationary part remote of the linear drive. Therefore, it is possible to arrange the linear drive, for example, at two panes of glass at a certain distance from one another in the region of the linear drive. This makes possible a "floating" mounting of the linear drive that is not dependent on the wall. The mounting is preferably carried out in that the suspending profile and the fastening part are screwed together, which enables mounting in an especially simple and, in particular, detachable manner.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1A:
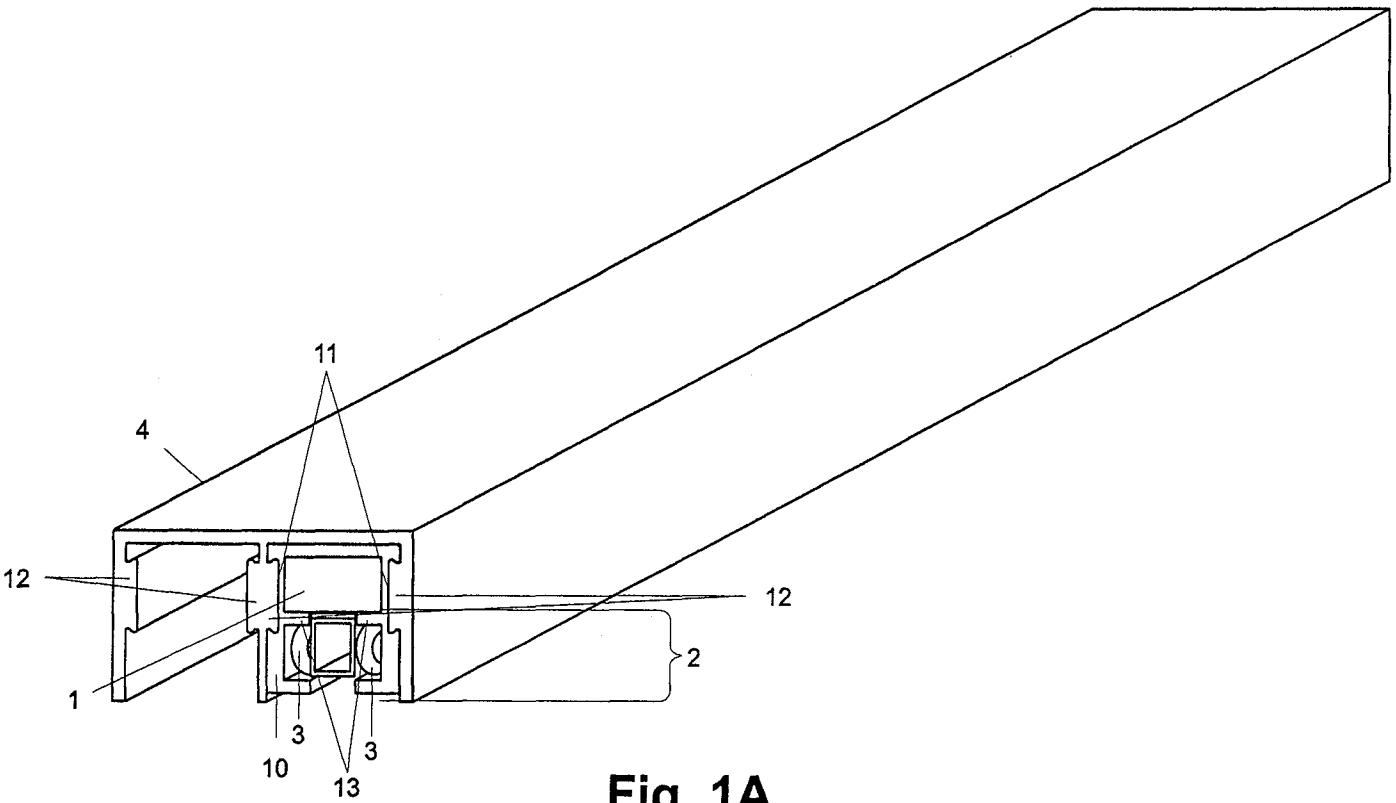
FIG. 1A is a perspective view of a linear drive according to a first embodiment form of the invention.

FIG. 1A shows a linear drive according to a first embodiment of the invention. The linear drive comprises a suspending profile 4 which has two receiving spaces lying next to one another, considered in longitudinal direction, for respective receiving profiles 10 of a respective linear motor. In the right-hand receiving space of FIG. 1A, a linear motor arrangement is shown. A stator part 1 of the linear motor shown here is received in the receiving profile 10 which is received in turn in the suspending profile 4.

The receiving profile 10 preferably has projections 13 that divide an interior space of the receiving profile 10 into an upper receiving space provided for receiving a stator part 1 and a lower receiving space provided for receiving a rotor part 2 of the linear motor. Rotor rollers 3 are preferably arranged at the rotor part 2 so as to be freely rotatable in such a way that they roll on surfaces of the projections 13 which face downward in FIG. 1A.

The suspending profile 4 is designed for a telescoping sliding door, i.e., a linear motor is received in the left-hand receiving space, this linear motor arranged to be offset with respect to the right-hand linear motor referring to FIG. 1A.

In case of a sliding door system with linear motors arranged in the right-hand receiving space, that is, in case of a one-leaf or two-leaf sliding door, the receiving space on the left-hand side of FIG. 1A is used for additional devices such as, e.g., sensors or the like.

According to FIG. 1A, the suspending profile 4 has a mounting portion or slide-on portion 12, preferably at side walls facing a respective receiving profile 10. The slide-on portions 12 are advantageously complementary in cross section to mounting portion or slide-on portions 11 which are arranged on the opposite side and which are formed at the respective receiving profile 10.

Therefore, during assembly of the linear drive, the receiving profiles 10 can be slid into the suspending profile 4 in a manner that makes assembly very simple.

Alternatively or in addition, outer dimensions or an outer contour of a respective receiving profile 10 is designed such that inner surfaces of the suspending profile 4 engage the receiving profile 10 in a clamping manner, which simplifies fixing a position of the receiving profile 10 in the suspending profile 4.

Figure 1B:
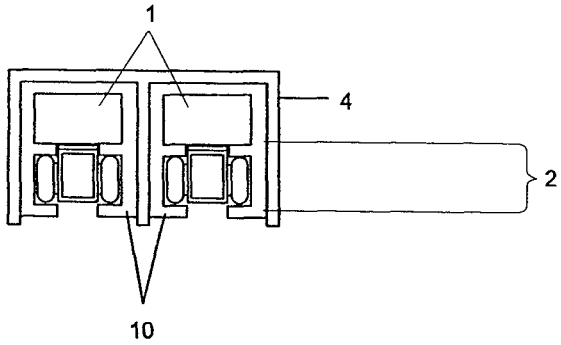
FIG. 1B is a front view of a linear drive according to a second embodiment form of the invention.

FIG. 1B shows a front view of a second embodiment of a linear drive according to the invention with clamping engagement in which the slide-on portions 11, 12 described above are omitted. FIG. 1B also shows two linear motors that are arranged next to one another.

Figure 2A:
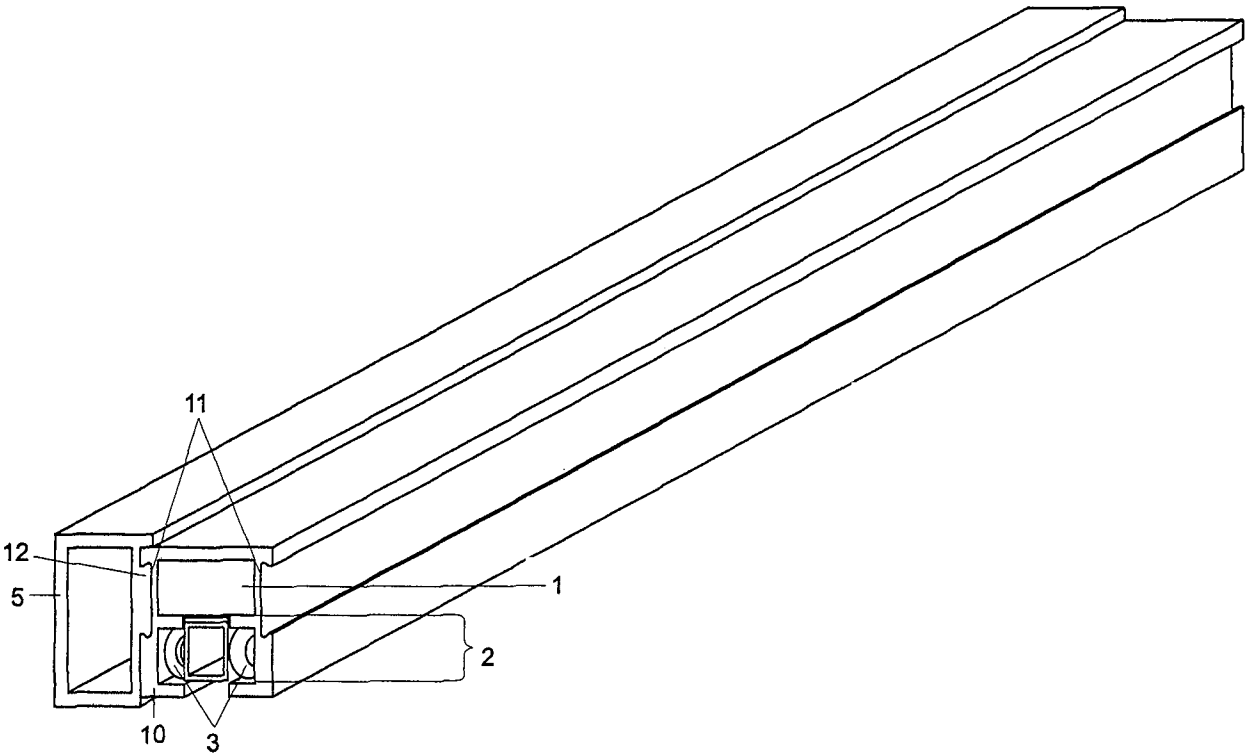
FIG. 2A is a perspective view of a linear drive according to a third embodiment form of the invention.

FIG. 2A is a perspective view of a linear drive according to a third embodiment form of the invention. The receiving profile 10 is provided with an accessory profile 5 instead of being received in a suspending profile 4. The accessory profile 5 preferably has, at least on one side facing the receiving profile 10, a mounting or slide-on portion 12 that is constructed similar to the slide-on portions 12 described above.

The accessory profile 5 is preferably provided for receiving additional devices. Such devices are, for example, a control module or control circuit 5*a* for the linear drive 5*a*, a locking module 5*b*, an emergency exit module 5*c*, an electric energy accumulator 5*d* or sensor module 5*e* (see FIG. 2B). The electric accumulator is provided, for example, for emergencies and is preferably formed by a storage battery or by high-power capacitors.

An active infrared sensor arrangement, for example, can be used in the accessory profile 5, and can monitor sharply delimited monitoring areas in front of the sliding door system or the like installations by means of infrared receivers, in front of which are arranged optics.

In one embodiment, a passive infrared system responding to general differences in temperature is provided.

The arrangement of modules of this kind in the accessory profile 5 decouples these modules with respect to their position in the accessory profile from the position of the linear motor. Accordingly, there is a greater degree of freedom in the mounting of the linear drive.

The accessory profile 5 is advantageously constructed as a panel or casing. This makes it possible to visually conceal the linear drive.

The accessory profile 5 offers advantages in retrofitting the linear drive. Modules or devices to be retrofitted can be assembled without having to remove the linear drive. The linear drive is suitable for prospective retrofitting in operation.

In one embodiment, the suspending profile 4 and accessory profile 5 are combined.

Figure 2B:
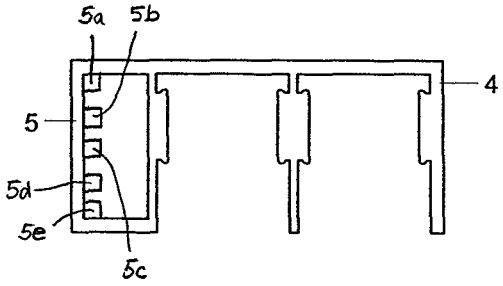
FIG. 2B shows a front view of a modified suspending profile.

As is shown in FIG. 2B, which is a front view of another embodiment of the suspending profile, the accessory profile 5 can be additionally formed at a left-hand side of the suspending profile 4 of FIG. 1A so as to create space for additional devices besides the receiving spaces of the suspending profile 4.

Figure 2C:
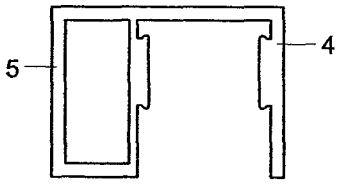
FIG. 2C is a front view of another modified suspending profile.

Alternatively, as is shown in FIG. 2C, which is a front view of another embodiment of the suspending profile, the accessory profile 5 is formed instead of the receiving space on the left-hand side in FIG. 1A.

Figure 3A:
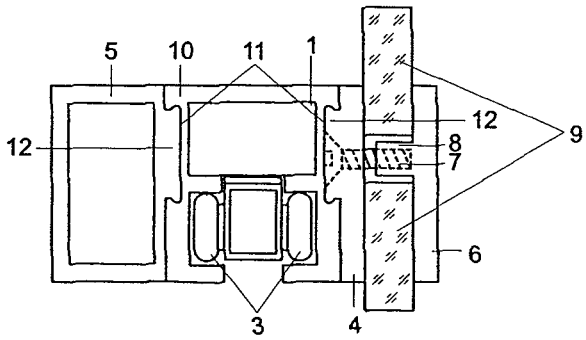
FIG. 3A is a front view of a linear drive according to a fourth embodiment form of the invention.

FIG. 3A shows a front view of a linear drive according to a fourth embodiment form of the invention. In contrast to the preceding embodiment forms, the suspending profile 4 has no receiving space, but rather is provided only for the suspension of the linear drive. However, the accessory profile 5 and suspending profile 4 can be constructed in such a way that they conceal the linear drive toward the top referring to FIG. 3A.

In this embodiment, the linear drive is arranged in a stationary manner at a fixed, relatively thin-walled part that is constructed as a glass pane 9. Further, a fastening part 6 is provided which is arranged at a side of the glass pane 9 remote of the linear drive.

The glass pane 9 preferably has through-openings at predetermined locations. The suspending profile 4 and fastening part 6 are fastened or fitted to one another through these through-openings. This is preferably effected by fastening screws 7 which are preferably threaded into the fastening part 6 so as to be guided through a respective through-opening in the suspending profile 4 through a respective through-opening in the glass pane 9. Guiding the fastening screws 7 through in direction of the fastening part 6 has the advantage that heads of the fastening screws 7 are concealed by the receiving profile 10. This facilitates mounting of the linear drive and allows the fastening means, that is, the fastening screws 7, to be invisible when assembly and mounting of the linear drive are completed.

In order to screw in a fastening screw 7, the fastening part preferably has sleeve portions 8 at corresponding locations. The sleeve portions 8 have internal thread portions for screwing in the fastening screws 7 and are formed so as to protrude in direction of the suspending profile 4. A respective sleeve portion 8 protrudes by an amount less than or equal to a depth of a corresponding through-opening of the glass pane 9.

When the protruding amount and the depth are identical, the respective sleeve portion 8 can completely conceal the respective fastening screw 7 in the region of the through-opening of the glass pane 9, which makes it possible to hide the fastening screws 7 in this region.

Although the embodiment form was described in connection with a single pane of glass 9, more than one glass pane 9 or combinations of various thin-walled parts are also conceivable. When there is a plurality of parts, these parts preferably have a distance from one another in the region of the fastening screws 7 that allows the fastening screws 7 and possibly the sleeve portions 8 to be guided through.

Of course, any connection or fastening can be used instead of fastening screws 7. In a preferred embodiment, the connection is preferably detachable.

Figure 3B:
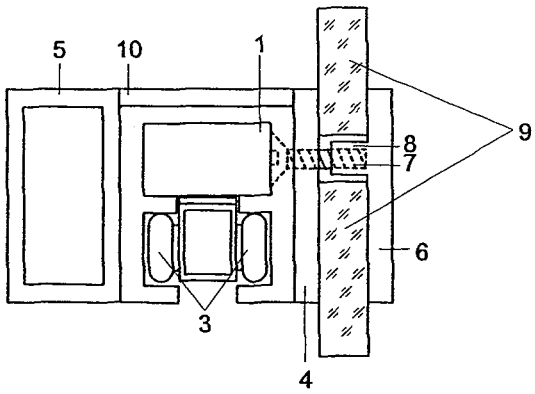
FIG. 3B is a front view of a linear drive according to a fifth embodiment form of the invention.

FIG. 3B shows a front view of a linear drive according to a fifth embodiment form of the invention. In contrast to the previous embodiment form, there are no slide-on portions 11, 12. Instead, the receiving profile 10 is screwed to the fastening part 6 by means of fastening screws 7 by the suspending profile 4.

In one embodiment, not all of the fastening screws 7 connect the receiving profile 10 to the suspending profile 4; that is, not all of the fastening screws 7 achieve an operative engagement with the fastening part 6. Alternatively, all of the fastening screws 7 which are arranged so as to pass through the receiving profile 10 connect only the receiving profile 10 to the suspending profile 4. In this embodiment, not all of the fastening screws are in operative engagement with the fastening part 6.

In one embodiment, the accessory profile 5 is fitted to the receiving profile 10, e.g., by means of glue. Alternatively or additionally, a screw fastening is provided.

In one embodiment, the accessory profile 5 and receiving profile 10 are formed integral with one another.

Although the invention was described in connection with sliding doors, it is applicable to all parts which are movable along a movement path, for example, curved sliding doors, telescoping sliding doors, circular sliding doors, dividing walls, or folding doors.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A linear drive for a part movable along a movement path, comprising:

a linear motor having a stator;

a receiving profile that fixedly retains the stator; and a fastening device to which the receiving profile is mounted, an installation side of the fastening device is further adapted to be mounted on a wall portion, wherein the receiving profile comprises projections dividing an interior space of the receiving profile into two receiving spaces, wherein the stator is received in one of the two receiving spaces and wherein a rotor part of the linear motor is received and guided in the other of the two receiving spaces, wherein the receiving profile has a slide-on portion on at least one lateral side thereof.

2. The linear drive according to claim 1, wherein the slide-on portion has a dovetail cross-sectional shape and extends in longitudinal direction of the receiving profile.

3. The linear drive according to claim 1, wherein an accessory profile is arranged at a side of the receiving profile remote from the fastening device, the accessory profile is designed to receive accessory devices.

4. The linear drive according to claim 3, wherein the accessory devices comprise at least one of a locking module, an emergency exit module, an energy accumulator and a sensor module.

5. The linear drive according to claim 1, wherein the fastening device comprises a suspending profile in which the receiving profile is received and held.

6. The linear drive according to claim 5, wherein the fastening device further comprises a fastening part which is arranged at least on one of one side of the top portion of a glass pane and the wall portion and at which the suspending profile is fastened, which suspending profile is arranged at the top section of a glass pane or a wall portion.

7. The linear drive according to claim 6, wherein at least the suspending profile and the fastening part are fastened together by a fastener.

8. The linear drive according to claim 6, wherein at least the suspending profile and the fastening part are glued together.

9. The linear drive according to claim 1, wherein the fastening device comprises a suspending profile at which the receiving profile is arranged in a stationary manner.

10. The linear drive according to claim 1, wherein the receiving profile extends longitudinally and forms a receiving space having a first portion and a second portion, the stator being arranged in the first portion of the receiving space, and wherein the linear drive includes a rotor longitudinally movably arranged in the second portion of the receiving space.

11. The linear drive according to claim 10, wherein the fastening device comprises a suspending profile in which the receiving profile is received and held.

12. The linear drive according to claim 11, wherein the fastening device further comprises a fastening part which is arranged at least on one of one side of the top portion of a glass pane and wall portion and at which the suspending profile is fastened, which suspending profile is arranged at the top section of a glass pane or the wall portion.

13. The linear drive according to claim 12, wherein at least the suspending profile and the fastening part are fastened together by a fastener.

14. The linear drive according to claim 12, wherein at least the suspending profile and the fastening part are glued together.

15. The linear drive according to claim 12, wherein at least one fastener is inserted through corresponding holes in the fastening part, the suspending profile and the receiving profile to mount the linear drive to the one of the top portion of a glass pane and the wall portion.

16. A linear drive for a part movable along a movement path, comprising:

a linear motor having a stator;

a receiving profile that fixedly retains the stator; and a fastening device to which the receiving profile is mounted, an installation side of the fastening device is further adapted to be mounted on a wall portion, wherein the receiving profile comprises projections dividing an interior space of the receiving profile into two receiving spaces, wherein the stator is received in one of the two receiving spaces and wherein a rotor part of the linear motor is received and guided in the other of the two receiving spaces wherein an accessory profile is arranged at a side of the receiving profile remote from the fastening device, the accessory profile is designed to receive accessory devices, and wherein the receiving profile has a first slide-on portion arranged at least on an outer side facing the accessory profile, wherein the accessory profile has, on the side facing the receiving profile, a second slide-on portion, wherein the second slide-on portion is arranged at the first slide-on portion of the receiving profile.

* * * * *